US007797769B2

(12) United States Patent
Ozenick

(10) Patent No.: US 7,797,769 B2
(45) Date of Patent: Sep. 21, 2010

(54) SANITARY, USER ACTIVATED, WATER SAVING, MOTION SENSING FLUSHING METHOD AND DEVICE

(76) Inventor: Debra Lynn Ozenick, 6209 Tiffany Oaks La., Arlington, TX (US) 76016

( * ) Notice: Subject to any disclaimer, the term of this patent is extended or adjusted under 35 U.S.C. 154(b) by 511 days.

(21) Appl. No.: 11/880,555

(22) Filed: Jul. 24, 2007

(65) Prior Publication Data

US 2008/0028507 A1 Feb. 7, 2008

Related U.S. Application Data

(60) Provisional application No. 60/834,583, filed on Aug. 1, 2006.

(51) Int. Cl.
*E03D 1/00* (2006.01)

(52) U.S. Cl. ..... 4/313; 4/302; 4/304; 4/305; 4/623; 4/DIG. 3

(58) Field of Classification Search ..... 4/313, 4/623, 301–305, DIG. 3
See application file for complete search history.

(56) References Cited

U.S. PATENT DOCUMENTS

| | | | | |
|---|---|---|---|---|
| 5,455,971 | A | 10/1995 | Sakakibara et al. | |
| 5,482,250 | A | 1/1996 | Kodaira | |
| 5,603,127 | A | 2/1997 | Veal | |
| 6,202,227 | B1 | 3/2001 | Gurowitz | |
| RE37,888 | E * | 10/2002 | Cretu-Petra | 4/623 |
| 6,618,864 | B2 * | 9/2003 | Veal | 4/313 |
| 6,671,890 | B2 * | 1/2004 | Nishioka | 4/304 |
| 7,107,631 | B2 * | 9/2006 | Lang et al. | 4/623 |
| 7,396,000 | B2 * | 7/2008 | Parsons et al. | 4/304 |
| 2006/0010591 | A1 | 1/2006 | Bush | |

* cited by examiner

*Primary Examiner*—Khoa D Huynh

(57) ABSTRACT

A flushing system with a sensing module, having at least one sensor and a controller circuit having a sensor detection and trigger sub-circuit operatively coupled to the at least one sensor, and a flushing mechanism operatively coupled to the motion sensing module.

2 Claims, 6 Drawing Sheets

700

701
Audio sensor senses word
702
Save sensed word in memory
703
Compare sensed word to words in look-up table
704
Match found?
No
Yes
705
Activate Flush Mechanism

SANITARY, USER ACTIVATED, WATER SAVING, MOTION SENSING FLUSHING METHOD AND DEVICE

CROSS REFERENCE TO RELATED APPLICATION

This application claims the benefit of U.S. Provisional Application No. 60/834,583 filed on Aug. 1, 2006, entitled "Sanitary, User Activated, Water Saving, Motion Sensing Flushing Device."

FIELD OF THE INVENTION

The present invention relates generally to plumbing actuation devices and methods such as automatic toilet and urinal flushing systems and, more particularly, but not by way of limitation, to a motion sensing device to activate a toilet, urinal, or other plumbing device adapted for sanitary waste disposal such as flushing in a manner facilitated by a non-touching, deliberate interaction of the user in a manner adapted to maintain minimal human contact while saving water.

BACKGROUND

There is a degree of confusion about when the first flushable toilet was invented. Some historians trace the origin of the first flushable toilet to King Minos of Crete who lived some 2800 years ago. It is said that the flushable toilet then disappeared for thousands of years until 1594 when Sir John Harrington built a flushable toilet known as the "prive in perfection' for his godmother, the Queen of England. The flushable toilet, however, again went on hiatus for several hundred years until a British plumber by the name of Thomas Crapper developed a flushable toilet in 1872. It was Thomas Crapper's development of the toilet that helped establish the toilet as a fixture of everyday life. The first flushable toilets were actually considered to be status symbols in Victorian England, often having ornate designs including elaborate hand-painted decorations and complex carvings such as swans and lions that held the water basins on their backs. Today, the flushable toilet is an inherent part of our everyday lives. It has undergone constant modification and improvement, resulting in many innovations, including toilets that flush automatically. The invention described herein below pertains to such a device.

A system for the automatic flushing of a toilet is set forth and shown in U.S. Pat. No. 5,603,127 wherein a tank-type toilet having one or more infrared transmitters is utilized to provide a sensed target area of approximately four feet in front of the toilet tank. The device allows for the automatic flushing of a toilet by detecting when a user has entered the sensed target area, and then flushing the toilet when the user has vacated the sensed target area.

Systems for the automatic flushing of toilets also providing sanitary flushing are generally known, and several such systems are currently in use today. One such system is set forth and shown in U.S. Pat. No. 5,482,250 (the '250 patent) wherein a device contains two sensing areas, one for the sensing of a body in front of the toilet and a second for the sensing of a body part to the side of the toilet. The second sensor is provided as a way to flush a toilet without physically making contact with the toilet, providing a sanitary method for the user to flush the toilet.

Another example of a sanitary flushing system is set forth and shown in U.S. Pat. No. 5,455,971 which discloses an automatic toilet flushing system which detects when a user sits on the toilet for use and, instead of operating a flush handle for flushing, performs flushing in association with the user's action of standing up to leave the toilet. Each of the foregoing inventions disadvantageously can be triggered inadvertently thus resulting in wastage of water.

SUMMARY OF THE INVENTION

The present invention relates to a sanitary, user-activated, water-saving, motion-sensing flushing method and device for plumbing systems. More particularly, one aspect of the invention utilizes a sensor positioned to sense an area directly to a side of a toilet so that a user can enter the sensing area, for example with user's hand, to activate the automatic, sanitary flushing of the toilet whenever the user so desires. An infrared sensor is discussed as the sensor of choice in this application, but it should be understood that other sensors commonly known in the art could be used instead.

One feature of the invention is that it provides a sanitary means of flushing a toilet. It is desirable to provide a means that does not involve touching a portion of the toilet because public lavatories are often not kept as clean as required. Providing a touch free means for flushing the toilet protects users from bacteria or other undesirable contaminants that may exist on the flushing lever or button.

Another feature of the invention is the ability to limit the number of flushes to conserve water. The invention is oriented in such a way that a flush of a toilet is only initiated upon the direct interaction with the sensing area, limiting the number of flushes to an amount needed or desired by a user. As noted above, the above referenced devices sense a user's initial presence and subsequent absence to flush the toilet. This wastes water because flushes tend to occur more frequently than the user actually desires.

The device may be powered by any conventional means including, but not limited to, commercial electricity, battery, and solar. In one embodiment, the device is used in conjunction with a standard toilet. A standard toilet may be any tank-type toilet where water is stored in the tank, or water is accessed from a central plumbing system. In another embodiment, the device is used in conjunction with a standup urinal. A standup urinal may be any toilet system that is fixed to a wall that allows a user to utilize the toilet system while standing. It should be noted that the device may be used in conjunction with other types of toilet applications, and is not limited to the ones listed above. Furthermore, the device may be adapted for use with toilet systems already in place, or may be included in new toilet systems.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DESCRIPTION OF THE DRAWINGS

A more complete understanding of the present invention may be obtained by reference to the following Detailed Description of Illustrative Embodiments of the Invention, when taken in conjunction with the accompanying Drawings, wherein.

DETAILED DESCRIPTION

Various embodiment(s) of the invention will now be described more fully with reference to the accompanying Drawings. The invention may, however, be embodied in many different forms and should not be construed as limited to the embodiment(s) set forth herein.

Figure 1:
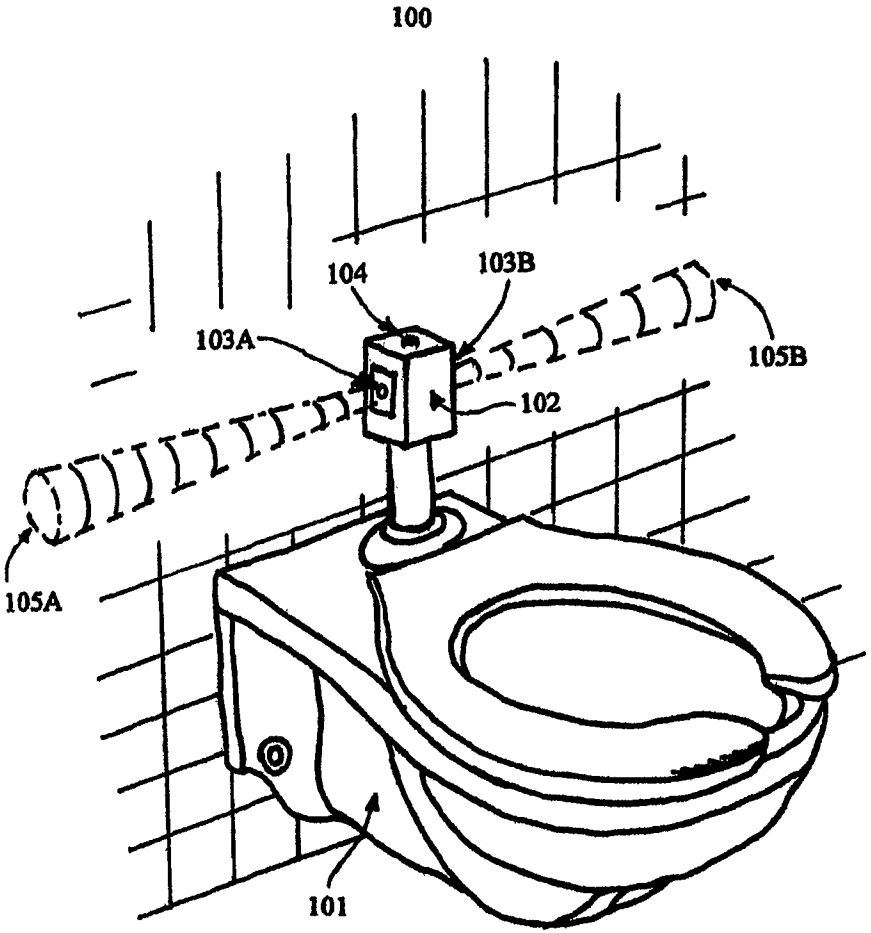
FIG. 1 is a perspective of a sanitary, user-activated, water-saving, motion-sensing flushing device for the use with a standard toilet.

Referring to FIG. 1, an embodiment of the sanitary, user-activated, water-saving, motion-sensing flushing device 100 for use with a conventional toilet 101 is shown. The device 100 includes a sensor housing 102, which includes: sensors 103A and 103B; and backup push button 104. Sensors 103A and 103B observe defined sensing areas 105A and 105B, respectively. The sensor housing 102 is situated on top of the flushing valve of a flushing mechanism for the control of the flushing valve.

Still referring to FIG. 1, when a user so desires, a flush of the toilet 101 may be accomplished through an interaction with the sensing area 105A or 105B. This interaction may be accomplished, for example, by reaching back with either of the user's hands to interrupt either of the sensing areas 105A or 105B.

Figure 2:
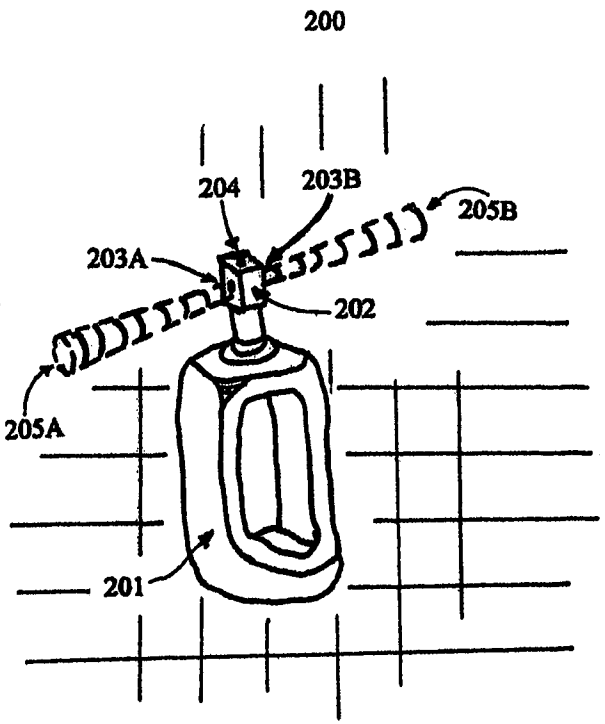
FIG. 2 is a perspective of the sanitary, user-activated, water-saving, motion-sensing flushing device for use with a standup urinal.

Referring now to FIG. 2, an embodiment of the sanitary, user-activated, water-saving, motion-sensing flushing device 200 for use with a standup urinal 201 is shown. The device 200 includes a sensor housing 202, which includes: sensors 203A and 203B, and backup push button 204. Sensors 203A and 203B observe defined sensing areas 205A and 205B, respectively. The sensor housing 202 is situated on top of the flushing valve of a flushing mechanism for the control of the flushing valve.

Still referring to FIG. 2, when a user so desires, a flush of the standup urinal 201 may be accomplished through an interaction with the sensing area 205A or 205B. This interaction may be accomplished, for example, by a wave with either of the user's hands to interrupt either of the sensing areas 205A or 205B.

Figure 3:
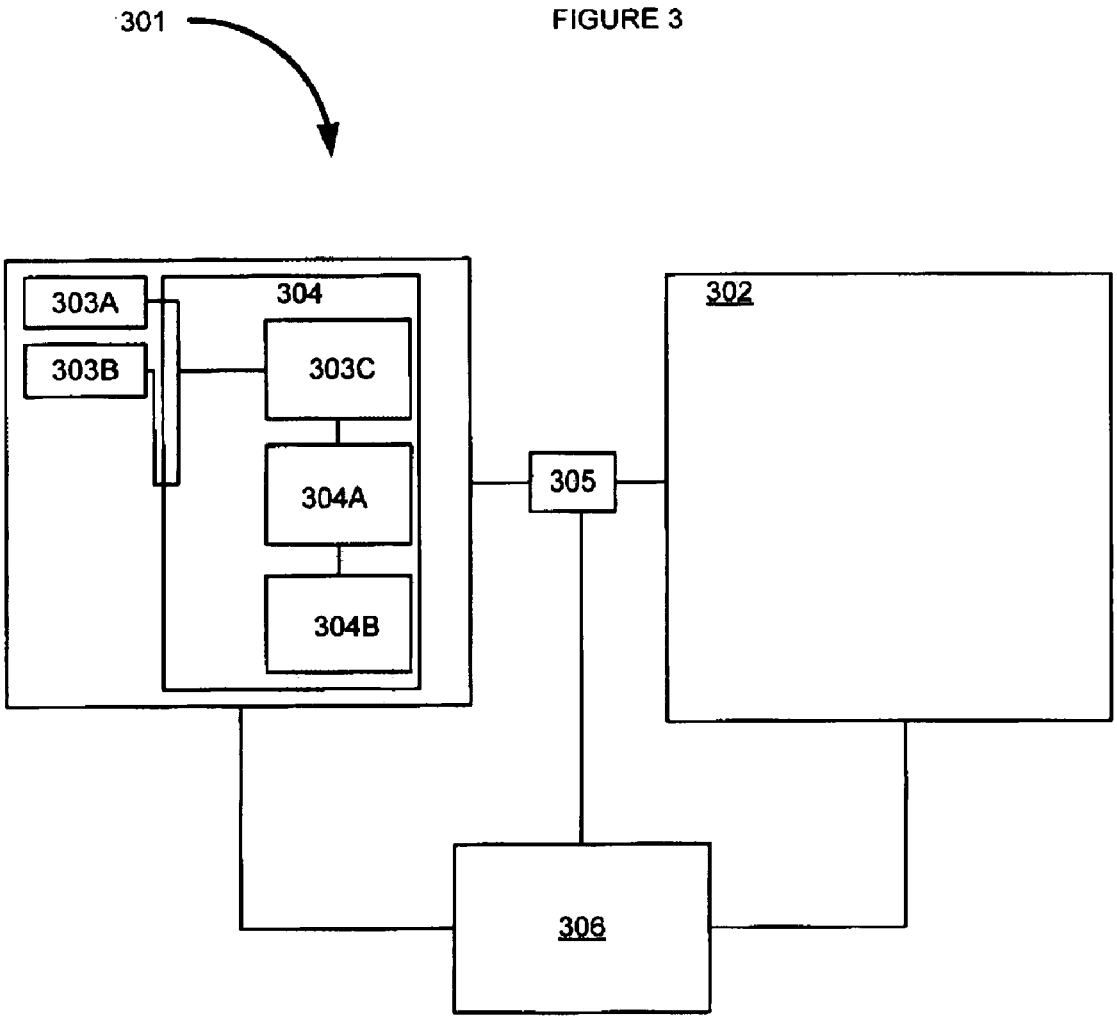
FIG. 3 is a block diagram of a motion sensing module coupled to a flushing device according to one embodiment of the invention.

Referring now to FIG. 3, a block diagram of a sensing module 301 coupled to a flushing mechanism 302 according to one embodiment of the invention is shown. As seen therein, sensing module 301 includes a plurality of sensors 303A, 303B coupled to a controller circuit 304. The controller circuit 304 is, for example, a low current circuit, having a microprocessor circuit 304A adapted to execute code, such as firmware, microcode or software (collectively, referred to as "code"). Such code is used, e.g., to implement methods of the present invention. The controller circuit 304 further includes an oscillator circuit 304B adapted to provide timing and clock signals to the controller circuit 304. Each of the sensors 303A, 303B is coupled to a detection and trigger sub-circuit 303C within controller circuit 304, each of which is triggered upon an appropriate sensing of, e.g., electrical or magnetic impulses, heat, motion, light or sound, by sensors 303A, 303B. A relay 305 may be used to bridge the low current requirements of the sensing module 301 to the higher current requirements of the flushing mechanism 302. The flushing mechanism 302 may include an inlet valve, outlet valve, flush diaphragm assembly and associated assemblies and drivers, adapted to cause water and effluent to be discharged from a toilet bowl or urinal and clean water to be introduced into the toilet bowl or urinal. Power for the invention can be, for example, provided from a power source (not shown) to a transformer 306 that has a plurality of taps and regulators to provide low power to sensing module 301 and higher power to flush mechanism 302.

Depending on the code executed by microprocessor circuit 304A, a variety of different triggering mechanisms can be used to activate flush mechanism 302. For example, sensors 303A and 303B may be infrared sensors and a flush may be activated if either sensor senses a wave of a hand within the detection area of the sensor. Alternatively, sensors 303A and 303B may be infrared sensors and a flush may be activated only if one wave of a hand is sensed on sensor 303A and then sensed by sensor 303B within a predetermined time period, such as 5 seconds. This type of specific requirement will greatly reduce the number of inadvertent flushes, thus saving water. Alternatively, sensor 303A may be a light sensor and sensor 303B may be an infrared sensor, such that both must be toggled to the TRUE position for the flush mechanism 302 to be activated. Hence, if the light in the restroom is off, no flush can occur, regardless of what is sensed at sensor 303B. Alternatively, the sensor may comprise a single audio sensor adapted to receive voice commands. The code can include voice recognition software executable by a voice recognition engine such that only a certain word such as "flush" can be used to activate the flush mechanism 302. In such embodiment, microprocessor circuit 304A includes a memory adapted to hold a look-up table of word sounds. When the audio sensor senses a word, the speech recognition engine compares the word to specific words in the look-up table and if a match is found, flush mechanism 302 is activated. As is known in the speech recognition art, there are a number of techniques available for comparison and matching. Most involve comparing a current window with known samples. Such methods may use Hidden Markov Models (HMM), frequency analysis, differential analysis, linear algebra techniques/shortcuts, spectral distortion, and time distortion methods. All these methods are used to generate a probability and accuracy match.

Figure 4:
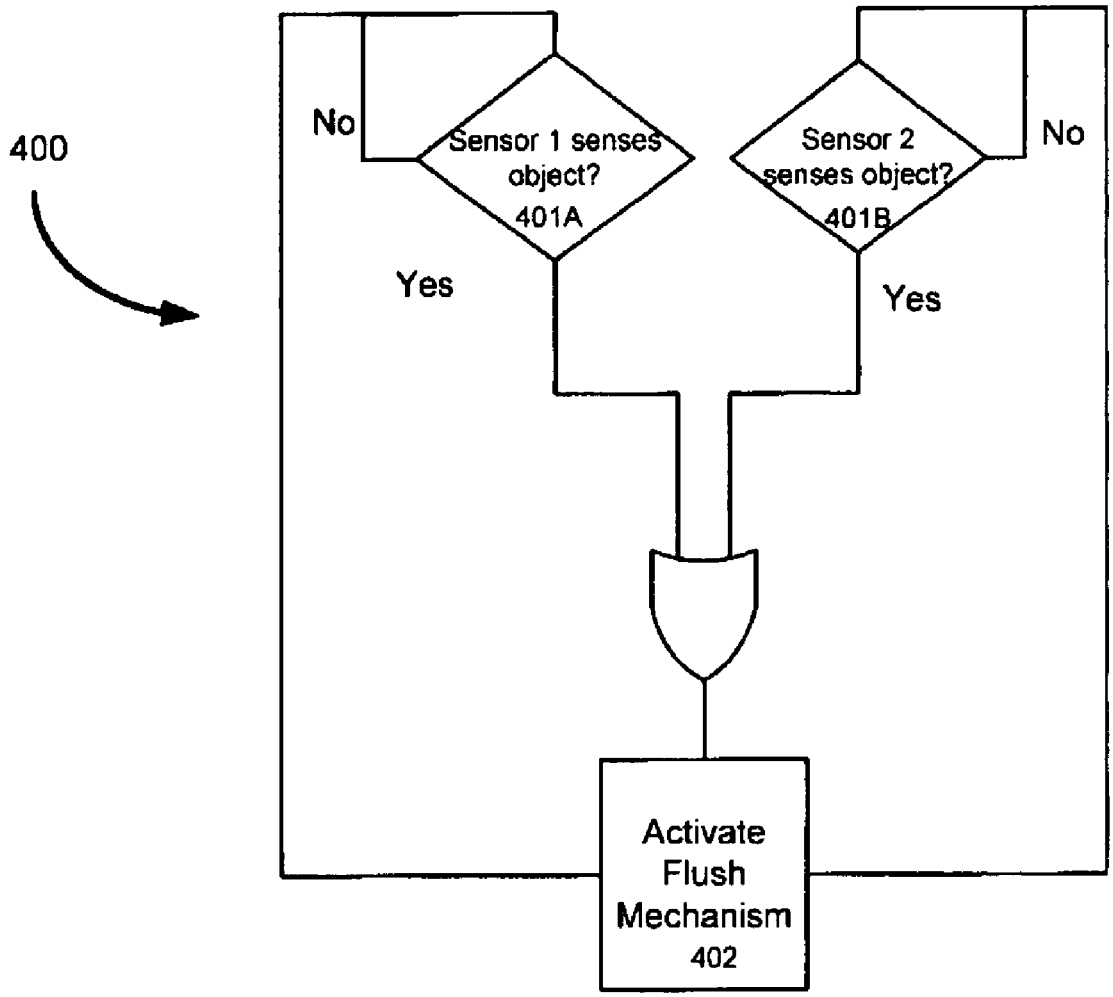
FIG. 4 is a flow chart of a first embodiment of a method of the present invention.
Figure 5:
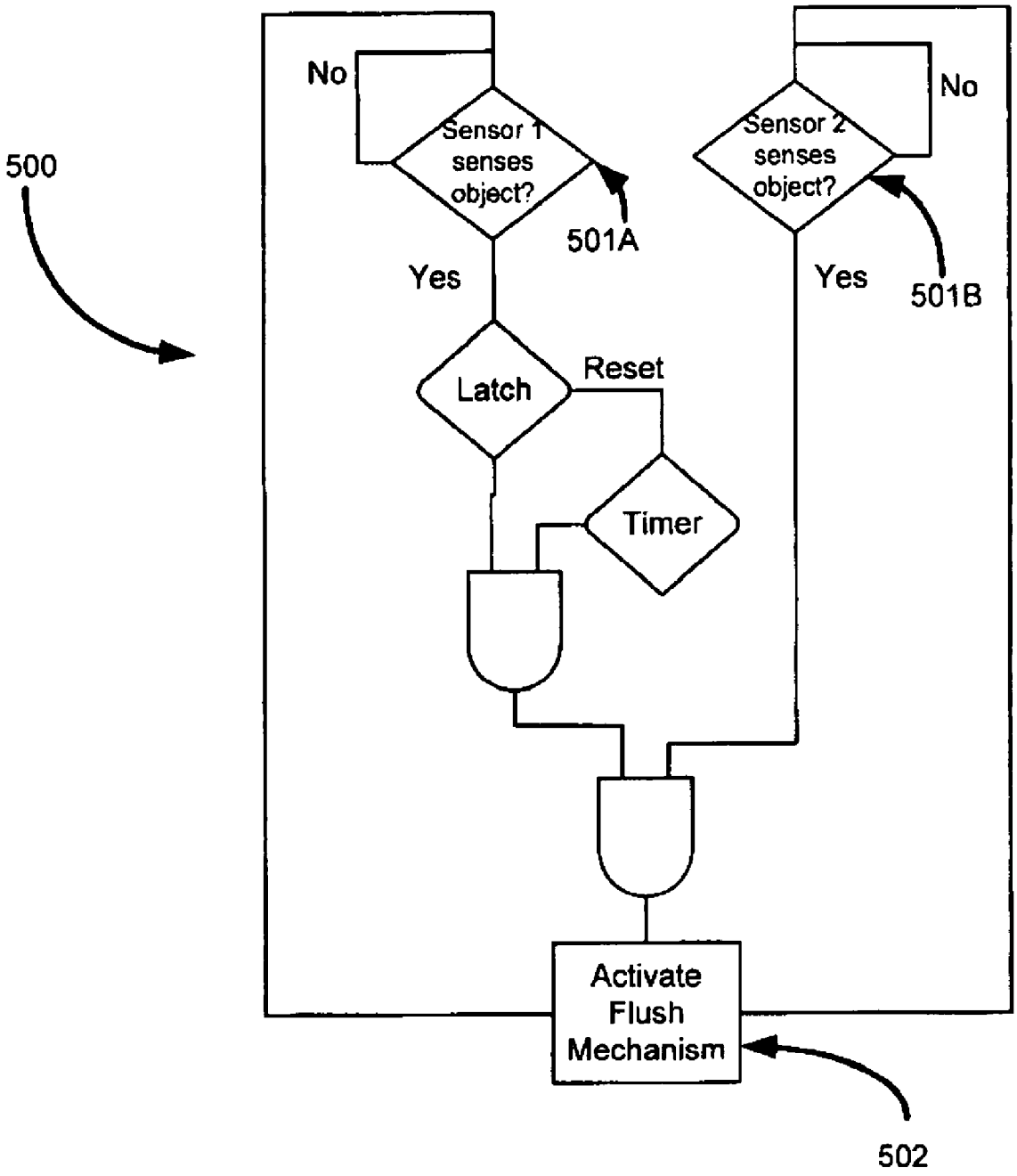
FIG. 5 is a flow chart of a second embodiment of a method of the present invention.
Figure 6:
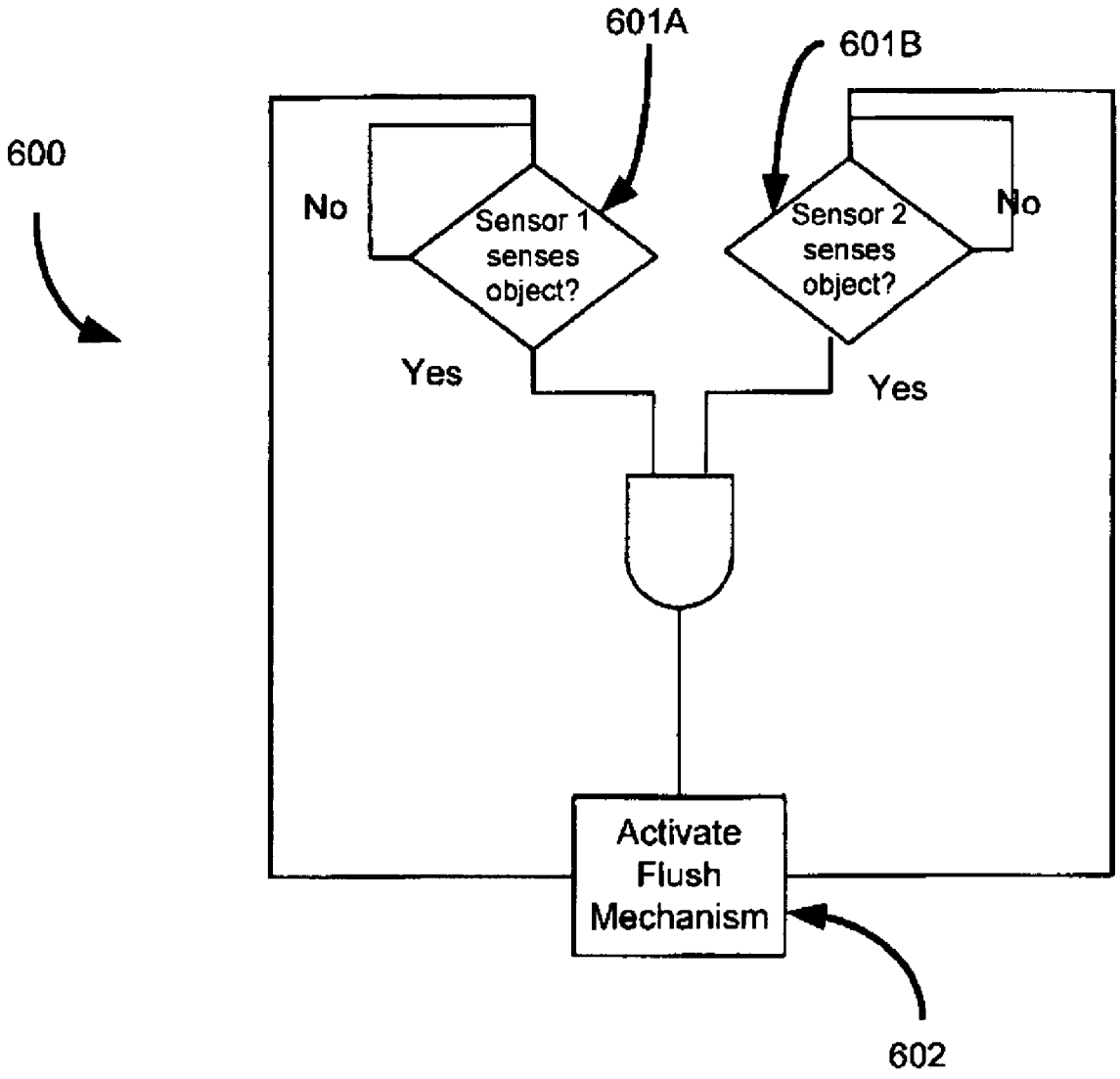
FIG. 6 is a flow chart of a third embodiment of a method of the present invention.
Figure 7:
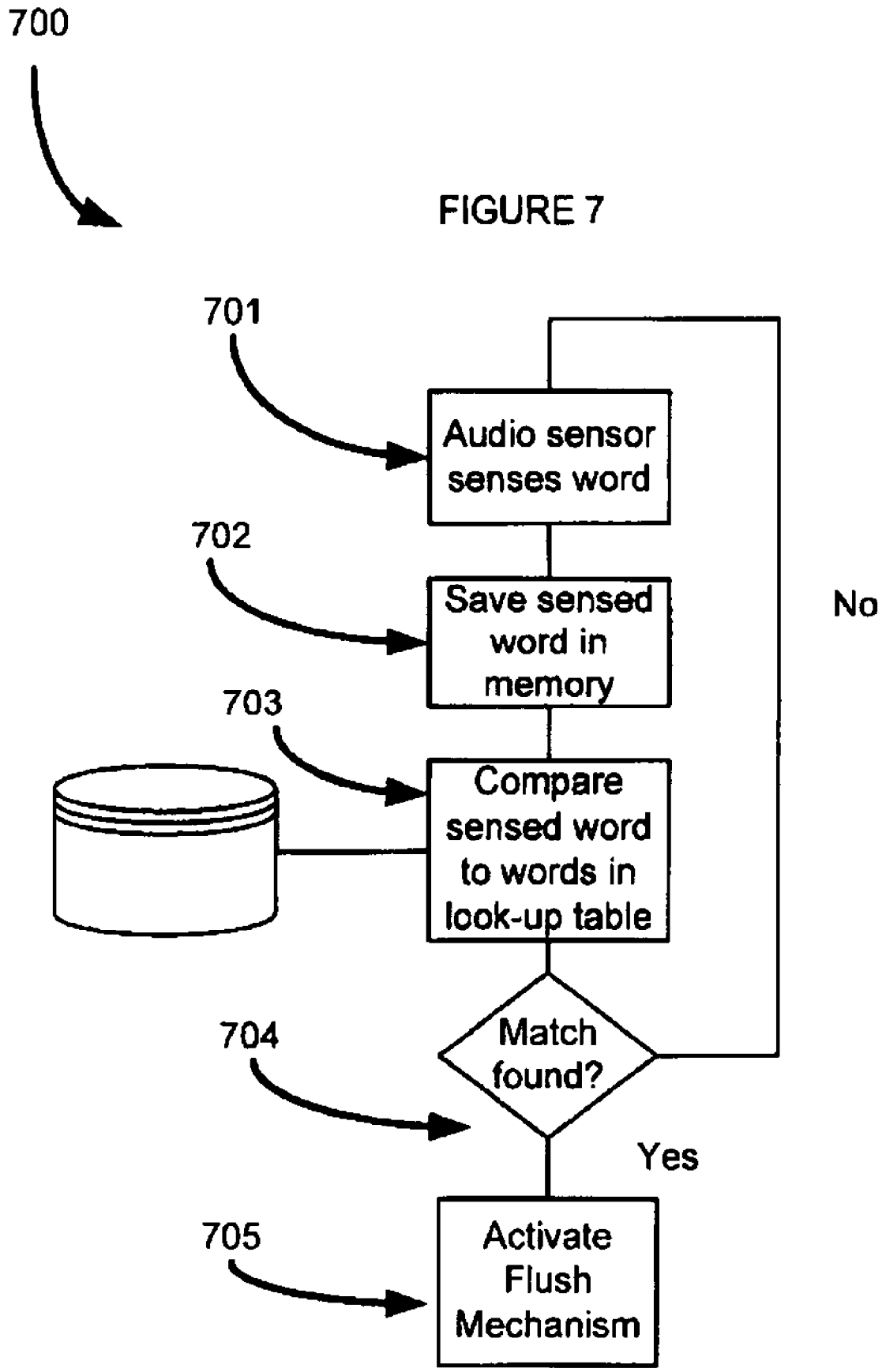
FIG. 7 is a flow chart of a fourth embodiment of a method of the present invention.

FIG. 4 is a flow chart 400 of a first embodiment of a method of the present invention. FIG. 5 is a flow chart 500 of a second embodiment of a method of the present invention. FIG. 6 is a flow chart 600 of a third embodiment of a method of the present invention, and FIG. 7 is a flow chart 700 of a fourth embodiment of a method of the present invention. In FIG. 4, the sensors are infrared sensors and if either sensor senses, in steps 401A, 401B, a wave of a hand, for example, within the detection area of the sensor, the flush mechanism is activated in step 402. This logic can be implemented using an OR gate. In FIG. 5, it is necessary to have each sensor toggled to TRUE, in steps 501A, 501B, within a certain time frame to activate the flush mechanism in step 502. This logic can be implemented using a latch, a variety of logic gates and a timer. As seen in FIG. 5, two AND gates implement the functionality. In FIG. 6, both sensors in steps 601A, 601B must be toggled to TRUE to activate the flush mechanism in step 602, without regard to a time requirement. This logic can be implemented using an AND gate. For example, in this method, a light sensor can be coupled to a first branch of a detection and trigger sub-circuit and the infrared sensor can be coupled to a second branch of the detection and trigger sub-circuit. The light sensor is adapted to detect light and, thereupon cause the first branch of the sensor detection and trigger sub-circuit to be toggled TRUE. The infrared sensor will have a defined volume of free space wherein a second branch of the detection and trigger sub-circuit is toggled TRUE if an object is detected within the defined volume of the infrared sensor. The controller circuit is then adapted to activate the flushing mechanism if both branches of the detection and trigger sub-circuit are toggled TRUE. In FIG. 7, a voice recognition circuit is used to activate the flush mechanism. In step 701, an audio sensor senses a word. In step 702, a digitized representation of the word is saved in a memory. In step 703, the digitized word is compared to words stored in a look-up table database. In step 704, if a match is found, then the flush mechanism is activated in step 705. If a match is not found, the method returns to step 701.

The embodiments shown and described above are only exemplary. Even though numerous characteristics and advantages of the present invention have been set forth in the foregoing description together with details of the invention, the disclosure is illustrative only and changes may be made within the principles of the invention to the full extent indicated by the broad general meaning of the terms used in the attached claims.

I claim:

1. A method of flushing a toilet, comprising the steps of:

providing a sanitary, user-activated, water-saving, motion-sensing flushing device comprising:

an electronically activated flushing valve within a toilet system, the toilet system having a standard toilet or a standup urinal;

a first motion sensor positioned on a first side of the toilet system and directed to sense a first detection area on the first side, the first motion sensor being responsively coupled to the electronically actuated flushing valve, and a second motion sensor positioned on a second side opposite of the first side and directed to sense a second detection area on the second side, said second motion sensor being responsively coupled to the electronically actuated flushing valve;

a sensing module having a controller circuit having a sensor detection and trigger sub-circuit and an oscillator timer, the flushing valve within a flushing mechanism operatively coupled to the sensing module, wherein the first motion sensor and second motion sensor each comprises a light sensor and an infrared sensor, respectively, the infrared sensor having a defined volume of free space wherein the flush mechanism is activated by the sensing module if an object is detected with the defined volume of free space, wherein the light sensor being coupled to a first branch of the detection and trigger sub-circuit and the infrared sensor being coupled to a second branch of the detection and trigger sub-circuit;

sensing the object within the first detection area of the first motion sensor coupled to the controller circuit having the sensor detection and trigger sub-circuit and the oscillator timer operatively coupled to the first motion sensor, and simultaneously or within a predetermined time period;

sensing the object within the second detection area of the second motion sensor coupled to the controller circuit having the sensor detection and trigger sub-circuit operatively coupled to the second motion sensor;

sensing light with the light sensor thereupon cause the first branch of the sensor detection and trigger sub-circuit to be toggled TRUE;

sensing if the object is first detected within the defined volume of the infrared sensor thereupon cause the second branch of the sensor detection and trigger sub-circuit to be toggled TRUE;

activating the flush mechanism of the toilet system coupled to the controller circuit upon the sensing of the object within the first detection area of the first motion sensor and the second detection area of the second motion sensor simultaneously or within the predetermined time period, wherein the sensor detection and trigger sub-circuit operable to be triggered if and only if the object is first detected within the defined volume of one of the first motion sensor or second motion sensor and then detected within the defined volume of the other of the first motion sensor or second motion sensor simultaneously or within a predetermined time period, said time period being programmed in code executable by the controller circuit and determined by the oscillator timer integral to or coupled to the controller circuit; and activating the flush mechanism coupled to the controller circuit if both branches of the sensor detection and trigger sub-circuit are toggled TRUE.

2. The method of claim 1, further comprising the steps of:

sensing a voice by an audio sensor coupled to a controller having voice recognition code executable thereon;

comparing at least one word inputted to the audio sensor with an predetermined word saved in a memory location of the controller circuit; and activating a flush mechanism upon the matching of the sensed word with the predetermined word and upon the sensing of the object within the detection area of the first motion sensor and second motion sensor simultaneously or within the predetermined time period.

* * * * *